US010576342B2

(12) United States Patent
Shear

(10) Patent No.: US 10,576,342 B2
(45) **Date of Patent: *Mar. 3, 2020**

(54) METAL WOOD CLUB

(71) Applicant: Acushnet Company, Fairhaven, MA (US)

(72) Inventor: David M. Shear, Bellevernon, PA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/193,991

(22) Filed: Nov. 16, 2018

(65) Prior Publication Data

US 2019/0083866 A1 Mar. 21, 2019

Related U.S. Application Data

(63) Continuation of application No. 15/624,543, filed on Jun. 15, 2017, now abandoned, which is a (Continued)

(51) Int. Cl.
*A63B 60/00* (2015.01)
*A63B 60/52* (2015.01)
(Continued)

(52) U.S. Cl.
CPC ..... *A63B 60/00* (2015.10); *A63B 53/00* (2013.01); *A63B 53/04* (2013.01);
(Continued)

(58) Field of Classification Search
CPC ..... A63B 60/00; A63B 60/52; A63B 53/04; A63B 53/00; A63B 53/0466; A63B 2053/0458; A63B 2053/0433; A63B 2053/0416; A63B 2053/0412; A63B 2053/0408; A63B 53/047
(Continued)

(56) References Cited

U.S. PATENT DOCUMENTS 819,900 A 5/1906 Martin
1,154,490 A 9/1915 Davis
(Continued)

FOREIGN PATENT DOCUMENTS

JP 1-91876 4/1989
JP 1-259876 10/1989
(Continued)

OTHER PUBLICATIONS

English Translation of JP 2002-52099.
(Continued)

*Primary Examiner* — Sebastiano Passaniti
(74) *Attorney, Agent, or Firm* — Randy K. Chang

(57) ABSTRACT

A golf club head is provided having a body and a face, with a slot in a perimeter region of the body of the club head adjacent the face. The slot increases the flex of the hitting surface on impact with a golf ball, thereby increasing the speed with which the ball rebounds off the hitting face and increases the overall distance the ball is hit. The slot preferably moves the sweet spot of the hitting face a distance X from the face center of the hitting face. The slot may be partially or wholly filled with an insert.

17 Claims, 9 Drawing Sheets

Related U.S. Application Data continuation of application No. 14/977,528, filed on Dec. 21, 2015, now Pat. No. 9,682,290, which is a continuation of application No. 14/257,579, filed on Apr. 21, 2014, now Pat. No. 9,216,324, which is a continuation of application No. 13/710,089, filed on Dec. 10, 2012, now Pat. No. 8,702,532, which is a continuation of application No. 12/972,842, filed on Dec. 20, 2010, now Pat. No. 8,328,659, which is a continuation of application No. 12/547,678, filed on Aug. 26, 2009, now Pat. No. 7,857,711, which is a continuation of application No. 11/216,840, filed on Aug. 31, 2005, now Pat. No. 7,582,024.

(51) Int. Cl.
*A63B 53/04* (2015.01)
*A63B 53/00* (2015.01)

(52) U.S. Cl.
CPC ..... *A63B 53/0466* (2013.01); *A63B 60/52* (2015.10); *A63B 53/047* (2013.01); *A63B 2053/0408* (2013.01); *A63B 2053/0412* (2013.01); *A63B 2053/0416* (2013.01); *A63B 2053/0433* (2013.01); *A63B 2053/0458* (2013.01)

(58) Field of Classification Search
USPC ..... 473/287–292
See application file for complete search history.

(56) References Cited

U.S. PATENT DOCUMENTS 1,705,997 A 3/1929 Quynn
1,854,548 A 4/1932 Hunt
2,034,936 A 3/1936 Barnhart
2,968,486 A 1/1961 Walton
3,061,310 A 10/1962 Giza
3,084,940 A 4/1963 Cissel
3,166,320 A 1/1965 Onions
4,113,249 A 9/1978 Beery
4,398,965 A 8/1983 Campau
4,575,447 A 3/1986 Hariguchi
5,076,585 A 12/1991 Bouquet
D323,035 S 1/1992 Yang
5,092,599 A 3/1992 Okumoto et al.
5,160,144 A 11/1992 Maniatis
5,346,219 A 9/1994 Pehoski et al.
5,492,327 A 2/1996 Biafore, Jr.
5,511,786 A 4/1996 Antonious
5,529,543 A 6/1996 Beaumont, Sr.
D375,130 S 10/1996 Hlinka et al.
D382,612 S 8/1997 Oyer
5,766,093 A 6/1998 Rohrer
5,772,527 A 6/1998 Liu
D413,952 S 9/1999 Oyer
6,042,486 A 3/2000 Gallagher
6,086,485 A 7/2000 Hamada et al.
6,344,001 B1 2/2002 Hamada et al.
6,348,013 B1 2/2002 Kosmatka
6,368,232 B1 4/2002 Hamada et al.
6,616,547 B2 9/2003 Vincent et al.
D482,089 S 11/2003 Burrows
D482,090 S 11/2003 Burrows
D482,420 S 11/2003 Burrows
D484,208 S 12/2003 Burrows
D486,542 S 2/2004 Burrows
6,743,118 B1 6/2004 Soracco
6,783,465 B2 8/2004 Matsunaga
D501,036 S 1/2005 Burrows
D501,903 S 2/2005 Tanaka
6,855,068 B2 2/2005 Antonious
D504,478 S 4/2005 Burrows
6,887,165 B2 5/2005 Tsurumaki
D506,236 S 6/2005 Evans et al.
D508,274 S 8/2005 Burrows
D520,585 S 5/2006 Hasebe
D523,104 S 6/2006 Hasebe
7,156,750 B2 1/2007 Nishitani et al.
D536,402 S 2/2007 Kawami
7,211,006 B2 5/2007 Chang
7,226,366 B2 6/2007 Galloway
7,241,230 B2 7/2007 Tsunoda
D552,701 S 10/2007 Ruggiero et al.
7,294,064 B2 11/2007 Tsurumaki et al.
7,318,782 B2 1/2008 Imamoto et al.
7,344,452 B2 3/2008 Imamoto et al.
7,347,795 B2 3/2008 Yamagishi et al.
7,396,293 B2 7/2008 Saracco
7,438,649 B2 10/2008 Ezaki et al.
7,470,201 B2 12/2008 Nakahara et al.
7,500,924 B2 3/2009 Yokota
7,530,901 B2 5/2009 Imamoto et al.
7,530,903 B2 5/2009 Imamoto et al.
7,572,193 B2 8/2009 Yokota
7,582,024 B2 9/2009 Shear
7,682,264 B2 3/2010 Hsu et al.
D616,952 S 6/2010 Oldknow
7,749,101 B2 * 7/2010 Imamoto ..... A63B 53/0466 473/332
7,857,711 B2 12/2010 Shear
7,896,753 B2 3/2011 Boyd et al.
7,934,998 B2 5/2011 Yokota
8,206,241 B2 6/2012 Boyd et al.
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,328,659 B2 12/2012 Shear
8,403,771 B1 3/2013 Rice et al.
8,430,763 B2 4/2013 Beach et al.
8,435,134 B2 5/2013 Tang et al.
8,517,860 B2 8/2013 Albertsen et al.
8,529,368 B2 9/2013 Rice et al.
8,579,728 B2 11/2013 Morales et al.
8,591,351 B2 11/2013 Albertsen et al.
8,632,419 B2 1/2014 Tang et al.
8,641,555 B2 2/2014 Stites et al.
8,702,532 B2 4/2014 Shear
8,753,222 B2 6/2014 Beach et al.
8,821,312 B2 9/2014 Burnett et al.
8,827,831 B2 9/2014 Burnett et al.
8,834,289 B2 9/2014 de la Cruz et al.
8,834,290 B2 9/2014 Bezilla et al.
8,858,360 B2 10/2014 Rice et al.
8,888,607 B2 11/2014 Harbert et al.
8,900,069 B2 12/2014 Beach et al.
8,956,242 B2 2/2015 Rice et al.
8,961,332 B2 2/2015 Galvan et al.
8,986,133 B2 3/2015 Bennett et al.
9,011,267 B2 4/2015 Burnett et al.
9,044,653 B2 6/2015 Wahl et al.
9,101,808 B2 8/2015 Stites et al.
9,101,809 B2 8/2015 Gibbs et al.
9,211,448 B2 12/2015 Bezilla et al.
9,216,324 B2 12/2015 Shear
9,220,953 B2 12/2015 Beach et al.
9,320,949 B2 4/2016 Golden et al.
9,409,067 B2 8/2016 de la Cruz et al.
9,421,433 B2 8/2016 Martens et al.
9,498,688 B2 11/2016 Galvan et al.
9,561,408 B2 2/2017 Bezilla et al.
9,636,552 B2 5/2017 Cleghorn et al.
9,636,559 B2 5/2017 de la Cruz et al.
9,675,850 B2 6/2017 Bennett et al.
9,682,290 B2 * 6/2017 Shear ..... A63B 53/0466
2002/0183134 A1 12/2002 Allen et al.
2003/0162607 A1 8/2003 Tsunoda et al.
2003/0220154 A1 11/2003 Anelli
2004/0176183 A1 9/2004 Tsurumaki

(56) References Cited

U.S. PATENT DOCUMENTS

| | | | | |
|---|---|---|---|---|
| 2004/0192463 | A1 | 9/2004 | Tsurumaki et al. | |
| 2005/0049081 | A1 | 3/2005 | Boone | |
| 2005/0059508 | A1* | 3/2005 | Burnett ..... | A63B 53/0466 473/349 |
| 2005/0119070 | A1 | 6/2005 | Kumamoto | |
| 2007/0026961 | A1 | 2/2007 | Hou | |
| 2007/0082751 | A1 | 4/2007 | Lo | |
| 2009/0275421 | A1 | 11/2009 | Gilbert et al. | |
| 2012/0142447 | A1 | 6/2012 | Boyd et al. | |
| 2012/0196701 | A1 | 8/2012 | Stites et al. | |
| 2012/0270676 | A1 | 10/2012 | Burnett et al. | |
| 2012/0289361 | A1 | 11/2012 | Beach et al. | |
| 2014/0080634 | A1 | 3/2014 | Golden et al. | |
| 2014/0378244 | A1 | 12/2014 | de la Cruz et al. | |
| 2015/0133233 | A1 | 5/2015 | Bezilla et al. | |
| 2015/0190688 | A1 | 7/2015 | Bennett et al. | |
| 2016/0184667 | A1 | 6/2016 | Deshmukh et al. | |
| 2017/0173411 | A1 | 6/2017 | Wahl et al. | |

FOREIGN PATENT DOCUMENTS

| | | |
|---|---|---|
| JP | 2002-52099 | 2/2002 |
| JP | 2003-93554 | 4/2003 |
| JP | 2003-290397 | 10/2003 |
| JP | 2004-174224 | 6/2004 |
| JP | 2004-275700 | 10/2004 |
| JP | 2004-313762 | 11/2004 |
| JP | 2004-351054 | 12/2004 |
| JP | 2004-351173 | 12/2004 |
| JP | 2006-167033 | 6/2006 |
| JP | 2006-345911 | 12/2006 |
| JP | 2007-136069 | 6/2007 |
| JP | 2008-067813 | 3/2008 |

OTHER PUBLICATIONS

English Translation of JP 2003-93554.
English Translation of JP 2006-167033.
English Translation of JP 2008-067813.

* cited by examiner

METAL WOOD CLUB

CROSS-REFERENCE TO RELATED APPLICATION

The present application is a continuation of U.S. patent application Ser. No. 15/624,543, filed Jun. 15, 2017, currently, which is a continuation of U.S. patent application Ser. No. 14/977,528, filed Dec. 21, 2015, now U.S. Pat. No. 9,682,290, which is a continuation of U.S. patent application Ser. No. 14/257,579, filed Apr. 21, 2014, now U.S. Pat. No. 9,216,324, which is a continuation of U.S. patent application Ser. No. 13/710,089, filed Dec. 10, 2012, now U.S. Pat. No. 8,702,532, which is a continuation of U.S. patent application Ser. No. 12/972,842, filed Dec. 20, 2010, now U.S. Pat. No. 8,328,659, which is a continuation of U.S. patent application Ser. No. 12/547,678, filed Aug. 26, 2009, now U.S. Pat. No. 7,857,711, which is a continuation of U.S patent application Ser. No. 11/216,840, filed Aug. 31, 2005, now U.S. Pat. No. 7,582,024, the disclosures of which are incorporated herein by reference in their entireties.

FIELD OF THE INVENTION

The present invention relates to an improved golf club head. More particularly, the present invention relates to a golf club head having a through-slot provided in a perimeter region of a body of the club head adjacent the face insert to improve the flex of the face of the club head.

BACKGROUND

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity, inertia, material selection, and overall head weight. While this basic set of criteria is generally the focus of golf club engineering, several other design aspects must also be addressed. The interior design of the club head may be tailored to achieve particular characteristics, such as the inclusion of hosel or shaft attachment means, perimeter weights on the club head, and fillers within hollow club heads.

Golf club heads must also be strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a uniform face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

The United States Golf Association (USGA), the governing body for the rules of golf in the United States, has specifications for the performance of golf balls. These performance specifications dictate the size and weight of a conforming golf ball. One USGA rule limits the golf ball's initial velocity after a prescribed impact to 250 feet per second±2% (or 255 feet per second maximum initial velocity). To achieve greater golf ball travel distance, ball velocity after impact and the coefficient of restitution of the ball-club impact must be maximized while remaining within this rule.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in all manufactured golf balls.

Viscoelastic relaxation of the ball is a parasitic energy source, which is dependent upon the rate of deformation. To minimize this effect, the rate of deformation must be reduced. This may be accomplished by allowing more club face deformation during impact. Since metallic deformation may be purely elastic, the strain energy stored in the club face is returned to the ball after impact thereby increasing the ball's outbound velocity after impact.

A variety of techniques may be utilized to vary the deformation of the club face, including uniform face thinning, thinned faces with ribbed stiffeners and varying thickness, among others. These designs should have sufficient structural integrity to withstand repeated impacts without permanently deforming the club face. In general, conventional club heads also exhibit wide variations in initial ball speed after impact, depending on the impact location on the face of the club. Hence, there remains a need in the art for a club head that has a larger "sweet zone" or zone of substantially uniform high initial ball speed.

Technological breakthroughs in recent years provide the average golfer with more distance, such as making larger head clubs while keeping the weight constant or even lighter, by casting consistently thinner shell thickness and going to lighter materials such as titanium. Also, the faces of clubs have been steadily becoming extremely thin. The thinner face maximizes the coefficient of restitution (COR). The more a face rebounds upon impact, the more energy that may be imparted to the ball, thereby increasing distance. In order to make the faces thinner, manufacturers have moved to a forged or stamped metal face which are stronger than cast faces. Common practice is to attach the forged or stamped metal face by welding them to the body or sole. The thinner faces are more vulnerable to failure. The present invention provides a novel manner for providing the face of the club with the desired flex and rebound at impact thereby maximizing COR.

SUMMARY OF THE INVENTION

The present invention relates to a golf club head adapted for attachment to a shaft. An embodiment of the present invention is a golf club head that includes a body having a perimeter region defining an opening and a face insert disposed in the opening. The face insert has a geometric face center and an area of maximum coefficient of restitution. At least one slot is disposed in the perimeter region of the body, wherein the area of maximum coefficient of restitution is disposed between the geometric face center and the slot. The club head may be for a fairway wood, a driver or iron.

The slot may be an elongated slot substantially parallel to a portion of an edge of the body. The slot may have a width of greater than 1 mm and a length of greater than 15 mm. The slot may comprise two opposing ends, the ends having expanded slot portions. The slot may provide a space in the body, such that the face insert flexes when the face insert impacts a golf ball. The slot may be substantially filled with at least one elastomeric material.

The face insert defines a face plane and the slot may be disposed less than 30 mm from the face plane. The area of maximum coefficient of restitution may be provided less than 20 mm from the geometric face center. In one embodiment, the coefficient of restitution may be provided less than about 10 mm from the geometric face center. In another embodiment, the area of maximum coefficient of restitution is provided within 2 mm of the geometric face center.

In one embodiment, the face insert defines a plane and at least one of the slots is disposed on a sole portion of the perimeter region adjacent the face plane. In another embodiment, the face insert defines a plane and at least one of the slots is disposed on a crown portion of the perimeter region adjacent the face plane. In another embodiment, the face insert defines a plane and at least one of the slots is disposed on a heel portion of the perimeter region adjacent the face plane. In yet another embodiment, the face insert defines a plane and at least one of the slots is disposed on a toe portion of the perimeter region adjacent the face plane.

The slot may increase the carry distance of a ball hit with the club head as compared with a club head without a slot. The slot may increase the speed at which a golf ball rebounds from the face insert of the club head as compared with a club head without a slot. In one embodiment, the speed at which a golf ball rebounds from the face insert of the club head is increased at least 0.5 mph as compared with a club head without a slot. The slot may increase the launch angle of a golf ball leaving the face insert after impact with the club head as compared with a club head without a slot. In one embodiment, the launch angle of a golf ball leaving the face insert is increased by at least 0.5 degrees as compared with a club head without a slot. The slot may decrease the back spin of a golf ball leaving the face insert after impact with the club head as compared with a club head without a slot. In one embodiment, the slot decreases back spin by at least 100 rpm as compared with a club head without a slot.

In another embodiment, a golf club head is provided. The club head includes a body having a perimeter region defining an opening and a face insert disposed in the opening. The face insert has a geometric face center and an area of maximum coefficient of restitution. At least one slot disposed in the perimeter region of the body, wherein the speed at which a golf ball rebounds from the face insert of the club head is increased at least 0.5 mph as compared with a club head without a slot. In one embodiment, the speed at which a golf ball rebounds from the face is increased at least 1 mph as compared with a conventional club head without a slot.

In another embodiment, a golf club head is provided. The club head includes a body having a perimeter region defining an opening and a face insert disposed in the opening. The face insert has a geometric face center and an area of maximum coefficient of restitution. At least one slot is disposed on the perimeter region of the body, wherein the area of maximum coefficient of restitution is disposed within a zone on the face insert and the maximum coefficient of restitution is closer to the geometric face center as compared with a club without a slot. In one embodiment, the coefficient of restitution over the entire face is at least 80% of the maximum coefficient of restitution within the zone.

In another embodiment, a golf club head is provided. The club head includes a body having a perimeter region defining an opening and a face insert disposed in the opening. The face insert has a geometric face center and an area of maximum coefficient of restitution. At least one slot is disposed on the perimeter region of the body, wherein a launch angle of a golf ball leaving the face insert is increased by at least 0.5 degrees as compared with a club head without a slot.

In another embodiment, a golf club head is provided. The club head includes a body having a perimeter region defining an opening and a face insert disposed in the opening. The face insert has a geometric face center and an area of maximum coefficient of restitution. At least one slot is disposed on the perimeter region of the body, wherein back spin is decreased by at least 100 rpm as compared with a club head without a slot.

In yet another embodiment, a golf club head is provided. The club head includes a body having a crown forming the upper surface of the body, a sole forming the lower surface of the body, a club face disposed between the crown and sole, the club face having a face center and an area of maximum resilience; and a transition region adjacent the sole and club face. The transition region defines a slot, wherein the area of maximum resilience is located a distance X from the face center.

In another embodiment, a golf club head comprises a face, a hollow body, and an elastomeric material. The face has a geometric face center and an area of maximum coefficient of restitution, and the maximum coefficient of restitution is greater than about 0.8. The face has at least two portions having different thicknesses. The hollow body has a toe portion, a heel portion, a sole portion, a hosel, a crown portion and a heel portion. The hollow body defines a perimeter region and an inner cavity. A slot is formed in the sole portion and at least a portion of the slot forms an opening into the inner cavity of the hollow body. The elastomeric material is disposed in the slot, and at least partially fills the slot. The elastomeric material extends into the inner cavity, and is held within the slot by at least one of an interference fit and an adhesive.

In another embodiment, a golf club head comprises a face, a hollow body, and an elastomeric material. The face has a geometric face center and an area of maximum coefficient of restitution, and the maximum coefficient of restitution is greater than about 0.8. The face has at least two portions having different thicknesses. The hollow body has a toe portion, a heel portion, a sole portion, a hosel, a crown portion and a heel portion. The hollow body defines a perimeter region and an inner cavity. A slot is formed in the sole portion and at least a portion of the slot forms an opening into the inner cavity of the hollow body. A first portion of the body forms a side of the slot closer to the face than a second portion of the body forming a side of the slot opposite the first portion. The first portion extends further into the inner cavity than the second portion to form a pathway to the inner cavity of the hollow body. The elastomeric material is disposed in the slot, and at least partially fills the slot. The elastomeric material extends into the inner cavity, and is held within the slot by at least one of an interference fit and an adhesive.

In a still further embodiment, a golf club head comprises a face, a hollow body, and an elastomeric insert. The face has a geometric face center and an area of maximum coefficient of restitution. The face has at least two portions having different thicknesses. The hollow body has a toe portion, a heel portion, a sole portion, a hosel, a crown portion and a heel portion. The hollow body defines a perimeter region and an inner cavity. A slot is formed in the sole portion and at least a portion of the slot forms an opening into the inner cavity of the hollow body. The elastomeric insert is disposed in the slot and at least partially fills the slot. The elastomeric insert has a protrusion, that engages a wall of the slot so that the insert is kept within the slot through normal use of the golf club head. The elastomeric insert is held within the slot by at least one of an interference fit and an adhesive. The area of maximum coefficient of restitution is disposed within a zone on the face and the area of maximum coefficient of restitution is disposed less than 20 mm from the geometric face center, and the maximum coefficient of restitution is at least about 0.81.

In another embodiment, the club head comprises a hollow body having a perimeter region and a face, and an elastomeric insert. The hollow body defines an inner cavity, and the face has a geometric face center and an area of maximum coefficient of restitution. The hollow body comprises a slot disposed in the perimeter region forming an opening into the inner cavity of the hollow body. The elastomeric insert is disposed in the slot, and at least partially fills the slot. An inner surface of the elastomeric insert is exposed to the inner cavity and an exterior surface of the elastomeric insert is exposed to an exterior of the golf club head. The elastomeric insert has a protrusion extending outward from a side wall of the elastomeric insert, and the protrusion extends into a groove in a wall of the slot so that the insert is kept within the slot. The area of maximum coefficient of restitution is disposed within a zone on the face, the area of maximum coefficient of restitution is disposed less than 20 mm from the geometric face center, and the maximum coefficient of restitution is at least about 0.82.

In another embodiment, a golf club head comprises a hollow body having a perimeter region and a face, and an elastomeric insert. The hollow body defines an inner cavity, and the face has a geometric face center and an area of maximum coefficient of restitution. The hollow body comprises a slot forming an opening into the inner cavity of the hollow body, and the slot is formed between a portion of a sole of the hollow body and a portion of the perimeter region. The elastomeric insert is disposed in the slot, and at least partially fills the slot. An inner surface of the elastomeric insert is exposed to the inner cavity and an exterior surface of the elastomeric insert is exposed to an exterior of the golf club head. The elastomeric insert has a protrusion extending outward from a side wall of the elastomeric insert, and the protrusion extends into a groove in a wall of the slot so that the insert is kept within the slot. The area of maximum coefficient of restitution is disposed within a zone on the face, the area of maximum coefficient of restitution is disposed less than 20 mm from the geometric face center, and the maximum coefficient of restitution is at least about 0.82.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

COR or coefficient of restitution is a measure of collision efficiency. COR is the ratio of the velocity of separation to the velocity of approach. In this model, therefore, COR was determined using the following formula:

$$(V_{club\text{-}post}-V_{ball\text{-}post})/(V_{ball\text{-}pre}-V_{club\text{-}pre})$$

where, $V_{club\text{-}post}$ represents the velocity of the club after impact;

$V_{ball\text{-}post}$ represents the velocity of the ball after impact;

$V_{club\text{-}pre}$ represents the velocity of the club before impact (a value of zero for USGA COR conditions); and $V_{ball\text{-}pre}$ represents the velocity of the ball before impact.

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

Figure 1:
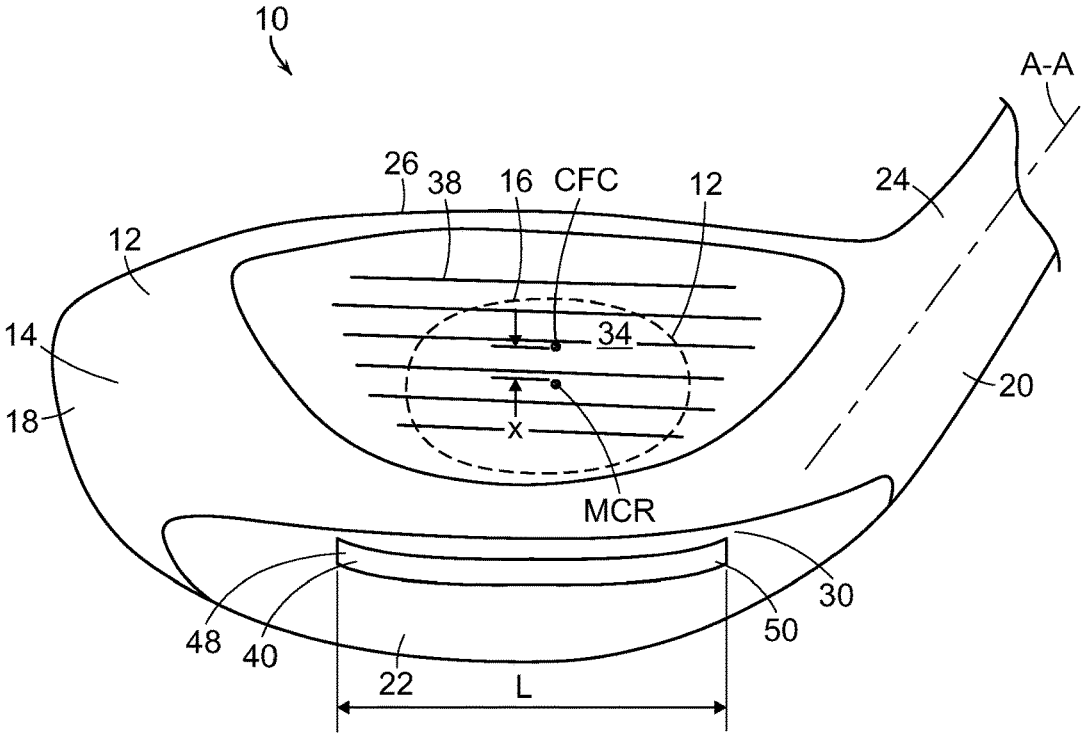
FIG. 1 is a perspective view of an embodiment of a club head of the present invention.

Referring to FIG. 1, a first embodiment of a golf club head 10 of the present invention is shown. Club head 10 includes shell 12 with body 14 and a face insert 16. The body 14 includes a toe portion 18, a heel portion 20, a sole portion 22, a hosel 24, a crown portion 26 and a skirt portion 28.

Figure 3:
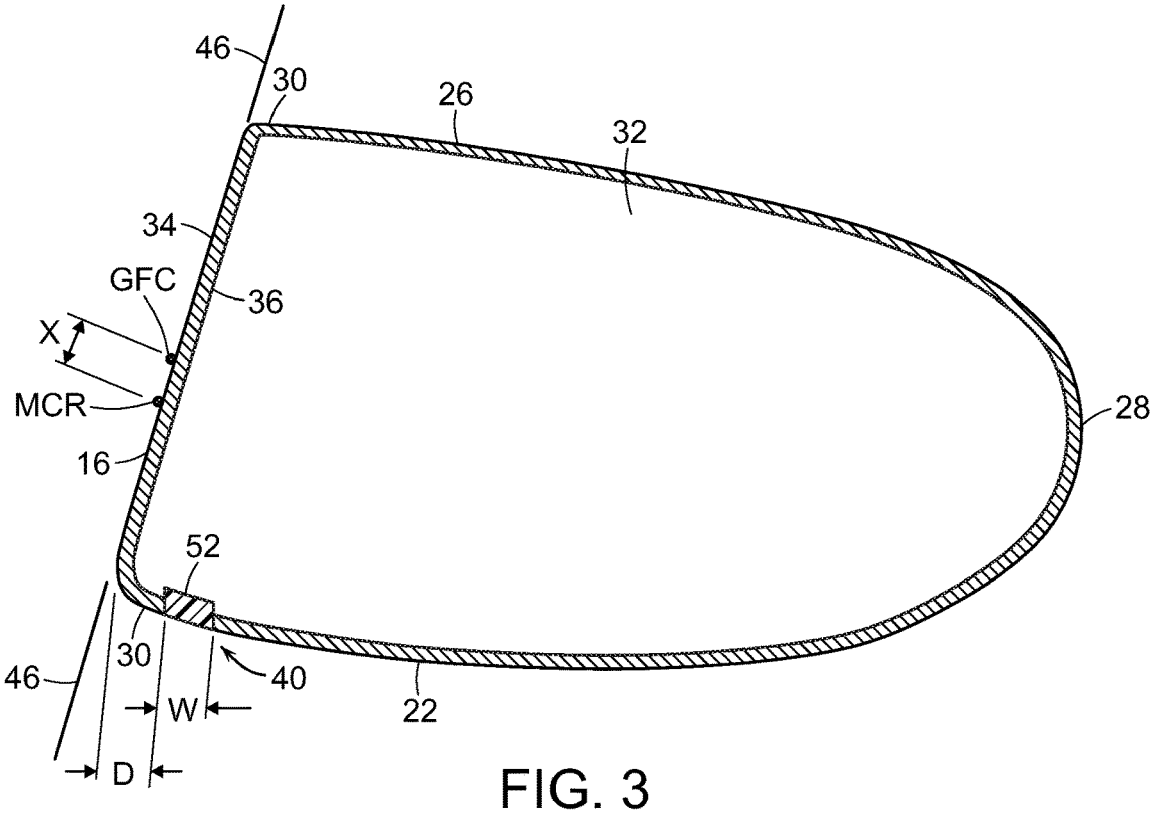
FIG. 3 is a cross-sectional view of the club head of FIG. 2 taken along line 3-3 in FIG. 1.

Optionally, the sole portion 22 may include a plate (not shown) that fits in a recess (not shown) in the bottom of the body 14. The body 14 also defines a face perimeter or perimeter region 30 adjacent the face insert 16. The body 14 and face insert 16 create an inner cavity 32 (FIG. 3). The face insert 16 has an exterior surface 34 and an interior surface 36 (FIG. 3). The exterior surface may have optional grooves 38.

A golf club shaft (not shown) is attached at hosel 24 and is disposed along a shaft axis A-A. The hosel 24 may extend to the bottom of the club head 10 and may terminate at a location between the sole and crown portions 22 and 26 of the head 10, or the hosel 24 may terminate flush with the crown portion 26 and extend into the cavity 32 in the head 10.

The inner cavity 32 of club head 10 may be empty, or alternatively may be filled with foam or other low specific gravity material. It is recommended that the inner cavity 32 have a volume greater than 250 cubic centimeters, and more preferably greater than 275 cubic centimeters. Preferably, the mass of the inventive club head 10 is greater than 150 grams, but less than 220 grams; although the club head may have any suitable weight. The body 14 may be formed of sheets welded together or cast, preferably from a titanium alloy any other suitable material.

The perimeter region 30 defines an opening for receiving the face insert 16. The face insert 16 is preferably connected to the perimeter region 30 of the body 14 by welding. For example, a plurality of chads (not shown) may be in alignment with an inner surface of the body to provide a pocket for receiving the face insert 16, which is therein integrally connected to the body 14 by welding. The face insert 16 may be made by milling, casting, forging or stamping and forming. The face insert 16 may be made of any suitable material, including titanium, titanium alloy, carbon steel, stainless steel, beryllium copper, and other metals or composites.

Alternatively, the body 14 and face insert 16 may be cast simultaneously forming a homogeneous shell and eliminating the need to bond or otherwise permanently secure a separate face insert 16 to the body 14. Alternatively, the sole portion 22 or crown portion 26 may be formed separately and fitted to the remainder of the shell as is known to those of skill in the art.

The thickness of the face insert 16 is preferably between about 0.5 mm and about 3 mm, although the face insert 16 may have any suitable thickness. The insert 16 may be of a uniform thickness as shown in FIG. 3 or have a variable thickness. For example, the face insert 16 may have a thicker center section and thinner outer section. In another embodiment, the face insert 16 may have two or more different thicknesses and the transition between thicknesses may be radiused or stepped. Alternatively, the face insert 16 may increase or decrease in thickness towards the toe, heel, sole or crown portions 18, 20, 22 and 26 of the club head 10. It will be appreciated that one or both of the exterior or interior surfaces 34 and 36 may have at least a portion that is curved, stepped or flat to vary the thickness of the face insert 16. As will also be appreciated, the face insert 16 may have any suitable construction.

Figure 2:
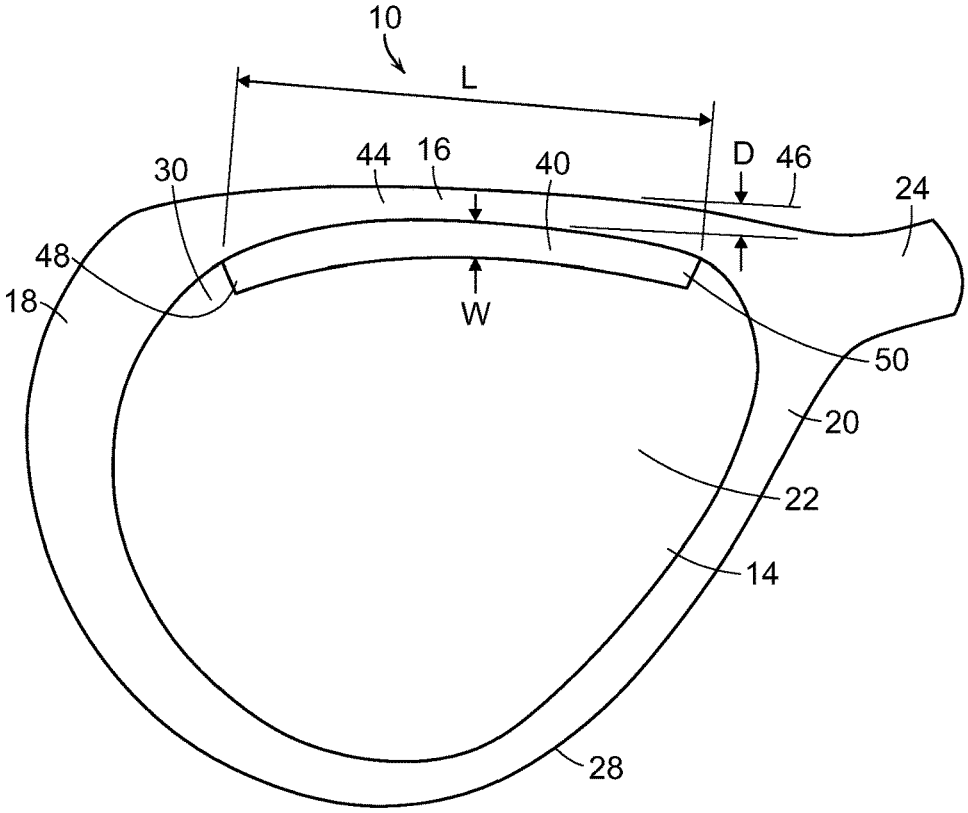
FIG. 2 is bottom plan view of an embodiment of a club head of FIG. 1.

As shown in FIGS. 1-2, a slot 40 is formed in the perimeter region 30. As illustrated, the slot 40 is elongated and is formed in the sole portion 22 of the body 14 of the club head 10. The slot 40 provides a space or opening in the club head 10, such that the face insert 16 flexes when the face insert 16 impacts a golf ball. This slot 40 allows the face insert 16 to flex differently than would otherwise be possible, and this flexure provides the benefit of longer distance and reduction in error for miss-hit shots. The slot 40 provides more forgiveness, such that a zone 42 for a sweet spot on the face insert 16 is increased, resulting in the ball being hit a consistent distance from a larger area on the face insert 16.

The slot 40 may provide a localized benefit of longer distance and reduction in error between the slot 40 and a geometric face center GFC of the face insert 16. For example, by providing a slot 40 in the perimeter region 30 adjacent the sole portion 22 of the club head, a reduction in error for thin shots, shots hit low on the club face, may be found. Thus, shots hit lower on the club face of the inventive club head will go farther than when compared with the same shot off a club face of a conventional club head. Similar results may be found for a club head 10 with slots 40 provided on other portions of the perimeter region 30 and shots hit away from the geometric face center GFC, between the face center and the slot 40.

In a preferred embodiment, the slot 40 is provided such that it is substantially parallel to a portion of an edge 44 of the body 14 and is provided within a certain distance D from a face plane 46 defined by the face insert 16. Preferably, the slot 40 is provided a distance D within 30 mm of the face plane 46 of the face insert 16, more preferably within 20 mm of the face plane 46, and most preferably within 10 mm of the face plane 46. The slot 40 has first and second opposing ends 48 and 50. Preferably, the slot is elongated. The slot 40 has a width W and a length L. Preferably, the slot 40 has a width W greater than 1 mm and a length L of greater than 15 mm. Although, it will be appreciated that the slot may have any suitable width or length.

The 40 slot may be formed in the perimeter region 30 by any suitable manner. Preferably, the slot is machined into the perimeter region 30 of the body 14 of the club head 10. Alternatively, the slot 40 may be cast, forged or stamped into the perimeter region 30 of the body 14 while the club head 10 is being formed.

The slot 40 may remain empty. However, as illustrated in FIGS. 3-4C, in order to comply with the United States Golf Association (USGA) rules, the slot 40 may be at least partially filled with one or more nonstructural or cosmetic materials 52. Preferably, the material is an elastomeric material, such as silicone. As illustrated in FIG. 3, the slot 40 is simply an opening in the body 14 of the club head 10. An elastomeric material may be provided within the opening.

The elastomeric material may be held within the slot by an interference fit, adhesive, or any other suitable means or combination thereof. The material may extend to any desired degree into the cavity 32 of the club head 10. As will be appreciated, if the cavity 32 of the club head is filled with a foam or other low specific gravity material, this may also fill the slot 40, such that it is not an exposed opening on the club head 10.

Figure 4A:
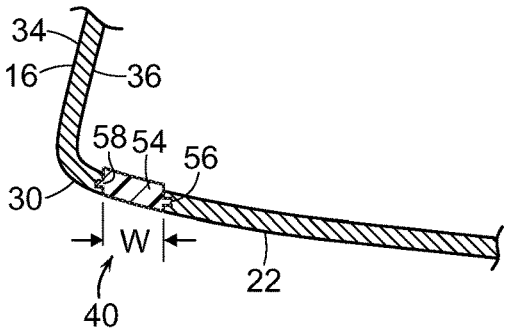
FIGS. 4A-C are detailed cross-sectional views of other embodiments of the club head of FIG. 2 taken along line 3-3 of FIG. 1.
Figure 4B:
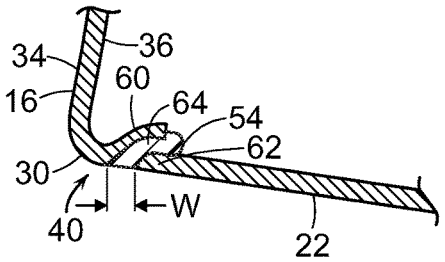
Figure 4C:
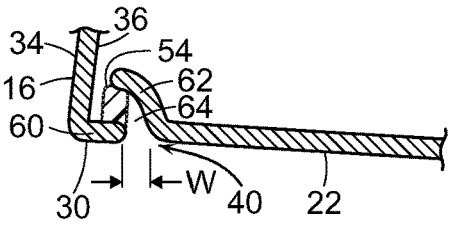

Referring now to FIGS. 4A-4C, the slot 40 may have numerous different constructions other than being a simple opening in the club head as shown in FIG. 3. Although, these embodiments illustrate the slot 40 formed adjacent the sole, it will be appreciated that slots of any of these constructions may be provided at any location on the perimeter region 30. In one embodiment, as illustrated in FIG. 4A, the slot 40 may be filled with an elastomeric insert 54. In order to keep the elastomeric insert 54 within the slot 40, the slot 40 may be provided with grooves 56 in the edges of the slot 40 along at least a portion of its length. The elastomeric insert 54 may have protrusions 58 that fit within the grooves 56, such that the insert is kept within the slot through normal use of the club head.

Alternatively, as shown in FIG. 4B, the slot 40 may be formed in the perimeter region 30 by having a portion 60 of the perimeter region 30 spaced from a portion 62 of the body 14 of the club head 10. As illustrated, the portion 60 of the perimeter region is bent into the cavity 32 of the club head 10 such that a pathway 64 between the body 14 and the perimeter region 30 is formed. The pathway 64 may be wholly or partially filled with one or more elastomeric materials.

In another embodiment illustrated in FIG. 4C, the portion 62 of the body 14 of the club head 10 may instead be bent inward into the cavity 32 of the club head forming a pathway 64 with the portion 60 of the perimeter region 30 to make the slot 40. As illustrated, the pathway 64 may be partially or wholly filled with one or more elastomeric materials.

Figure 5:
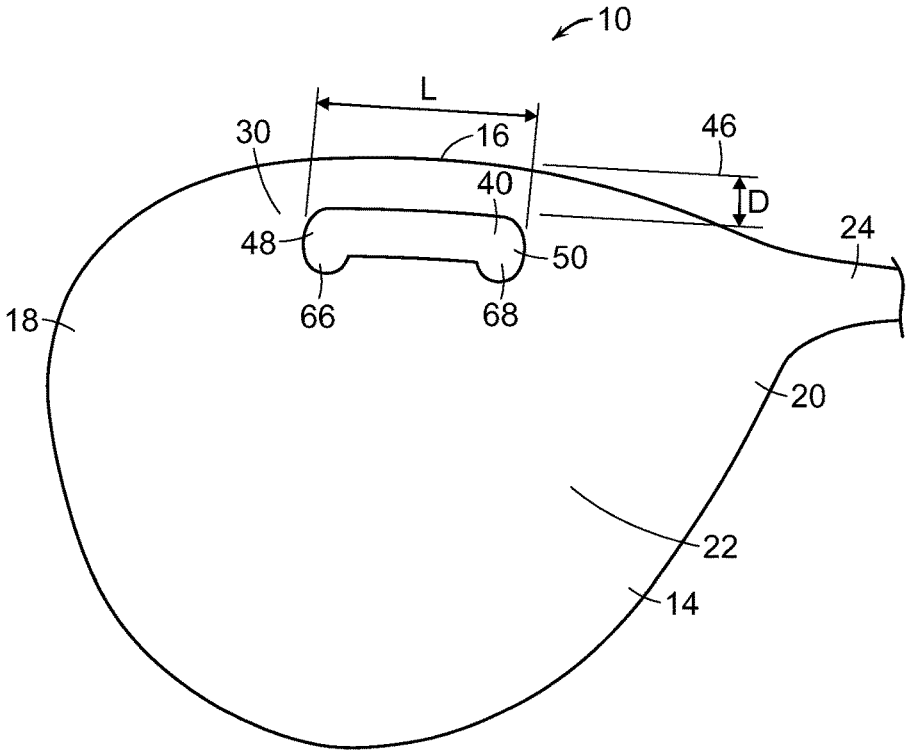
FIG. 5 is a bottom perspective view of another alternative embodiment of a club head of the present invention.

In another embodiment illustrated in FIG. 5, in order to reduce stress on the slot 40, the opposing ends 48 and 50 of the slot 40 may have expanded slot portions 66 and 68. The expanded slot portions at the ends of the slot reduce stress on the slot that may occur during normal play. This may reduce the chance of a fracture occurring at one or both ends of the slot.

Figure 6:
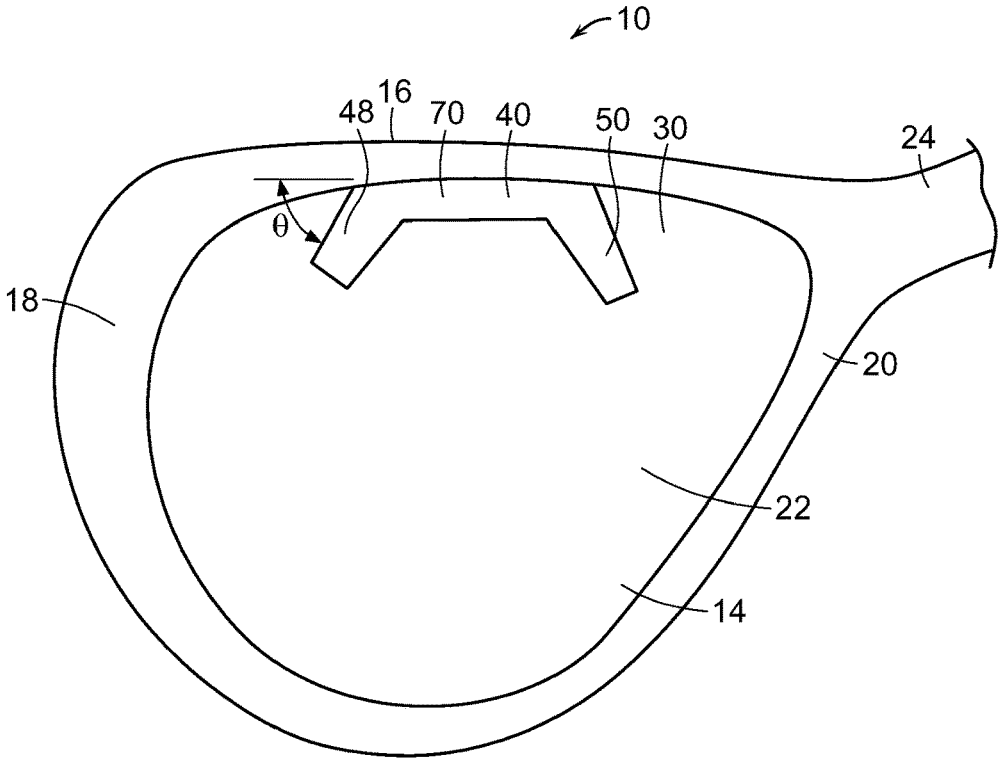
FIG. 6 is a bottom perspective view of another alternative embodiment of a club head of the present invention.

It will be appreciated that the slot may have different shapes other than a simple straight slot, an elongated slot or a slot with expanded slot portions. The slot may have a C-shape. For example as illustrated in FIG. 6, the slot 40 may have the opposing ends 48 and 50 angled from a center portion 70 of the slot 40. The opposing ends 48 and 50 may be angled at any desired angle θ relative to the center portion or have any desired curvature or radius.

Figure 7:
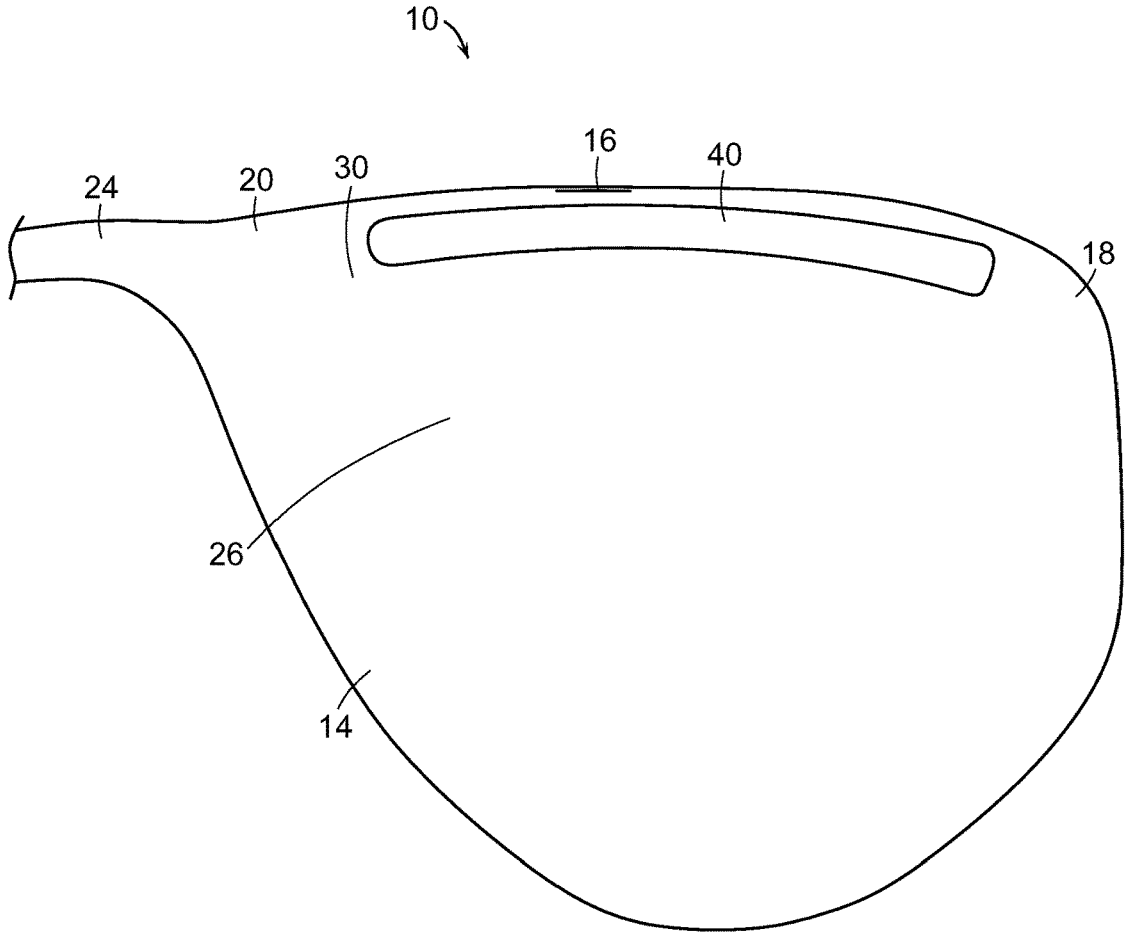
FIG. 7 is a top perspective view of another alternative embodiment of a club head of the present invention.
Figure 8:
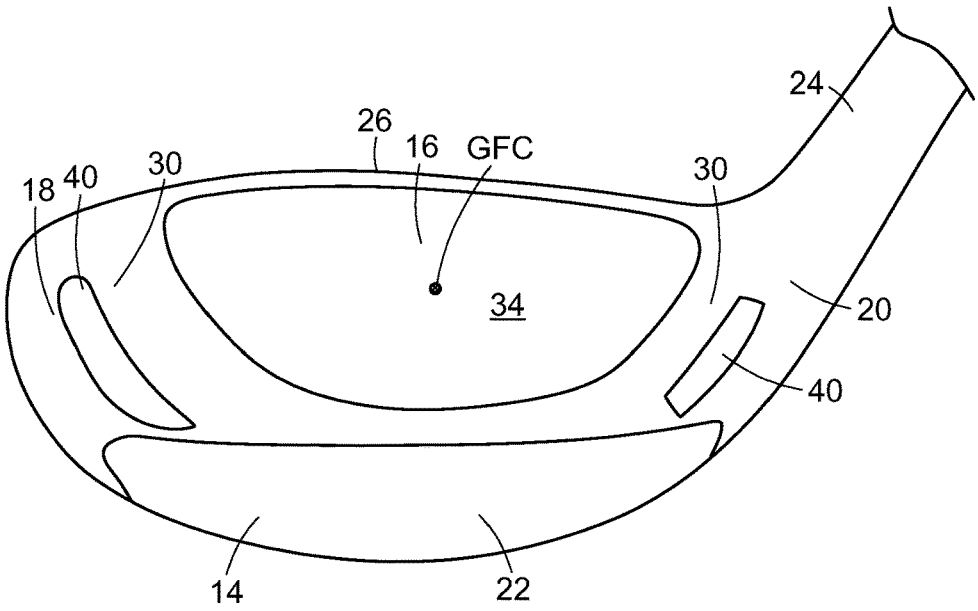
FIG. 8 is a front perspective view of another alternative embodiment of a club head of the present invention.

In an alternative embodiment illustrated in FIG. 7, the slot 40 may be provided in the perimeter region 30 on the crown portion 26 of the body 14 of the club head 10. Additionally, as illustrated in FIG. 8, slots 40 may be provided in one or both of the toe or heel portions 18, 20 of the body of the club head. By placing one or more slots 40 in different areas of the perimeter region 30, the flex of the face insert 16 may be modified compared with a conventional club face. The change in flex may result in more distance and greater accuracy for miss-hit shots. For example, by providing the slot 40 in the perimeter region 30 adjacent the crown portion 26 of the club head, a reduction in error for shots hit high on the club face may be found. Thus, shots hit higher on the club face of the inventive club will go farther than when compared with the same shot off a club face with a conventional club head. A slot provided adjacent the toe or heel portion 18, 20 will achieve similar results for shots hit between the geometric face center GFC and either the toe or heel.

It will be appreciated that one or more of the slots illustrated in FIGS. 1-8 may be combined with one another. It will be appreciated that providing slots in each of the toe, heel, sole and crown portions 18, 20, 22 and 26 of the perimeter region 30 may provide global improvement to the overall distance; however, localized benefits between the geometric face center GFC and each slot may be decreased. Additionally, it will be appreciated that the slot 40 may not be a single slot, but may be comprised of multiple openings (not shown) that form the slot 40.

As illustrated, the slot 40 is provided in a fairway wood; however, it will be appreciated that the slot 40 may be provided in a driver or iron. In particular, it may be beneficial to provide a slot 40 on a driver in the crown portion and/or both the crown portion and sole portion. For irons, a slot 40 in the sole portion might provide the same benefits as for a fairway wood, increased distance and forgiveness for thin shots. Preferably, an iron with a slot according to the invention would have a thin face.

As will be appreciated, the face insert 16 has a geometric face center GFC and an area of maximum coefficient of restitution or maximum resilience. Preferably, the area of maximum resilience is disposed between the geometric face center GFC and the slot 40. In another embodiment, the area of maximum coefficient of restitution is disposed within the zone 42 on the face insert 16 and the maximum coefficient of restitution is closer to the geometric face center GFC as compared with a club head without a slot. Preferably, the coefficient of restitution over the entire face insert 16 is at least 70% and more preferably at least 80% of the maximum coefficient of restitution within the zone 42.

In another embodiment, the area of maximum coefficient of restitution MCR is provided a distance X from the geometric face center GFC. Preferably, the distance X is less than about 20 mm, more preferably less than about 10 mm. In another embodiment, the maximum coefficient of restitution is within 2 mm of the geometric face center GFC. It is expected that as the COR increases the ball flight distance will increase and the maximum total distance will increase. The COR of the area between the geometric face center GFC and the slot 40 may be increased. For the inventive club head, preferably the COR is greater than about 0.8, and more preferably greater than 0.81. Preferably, the COR for the zone 42 is at least about 0.81, and more preferably, at least about 0.82.

Figure 9:
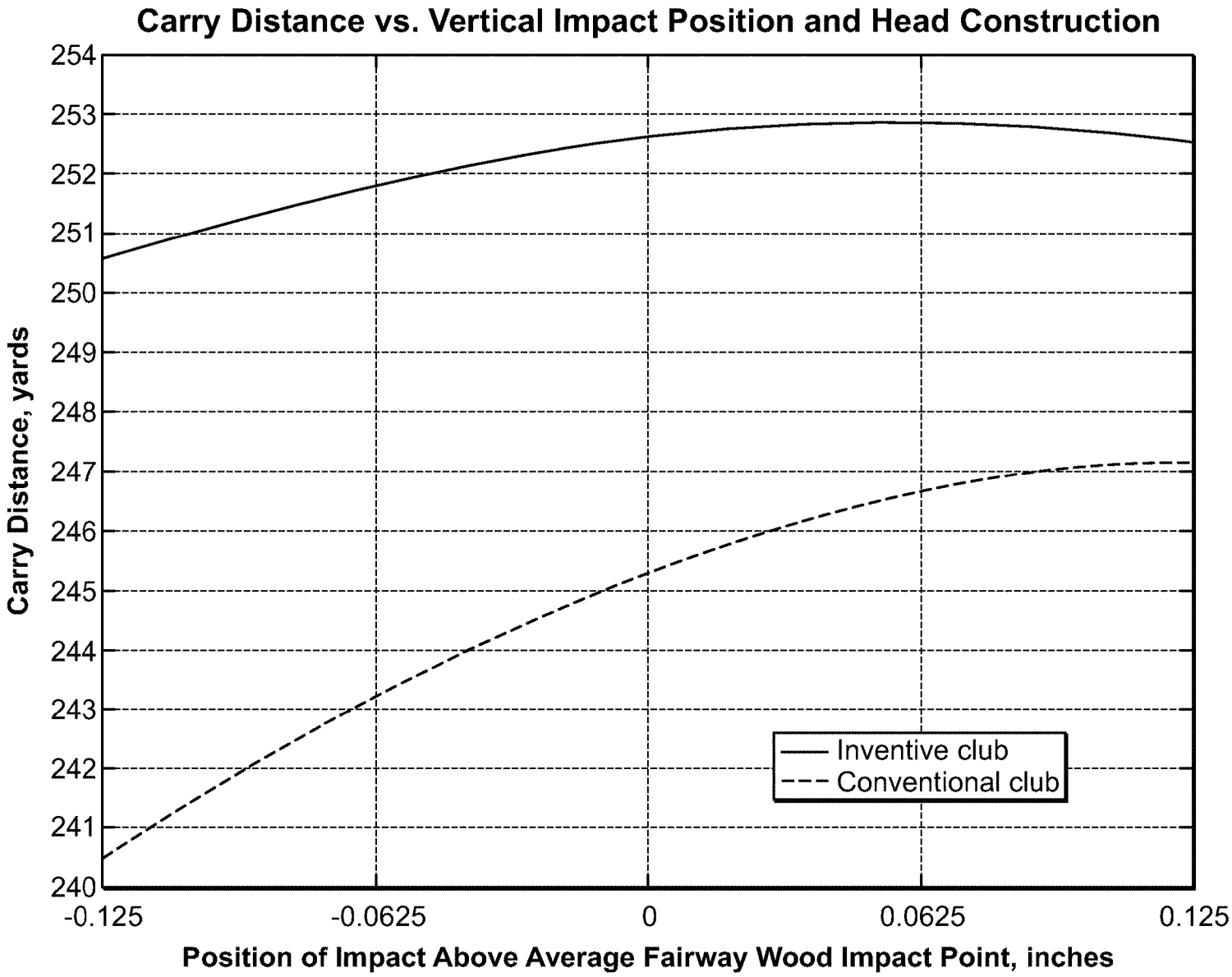
FIG. 9 is a graph of estimated carry distance versus vertical impact position for the inventive club and a conventional club.

Now referring to FIG. 9, the graph plots carry distance versus vertical impact position and head construction comparing a conventional club with an inventive club having a slot 40 as illustrated in FIG. 1. As illustrated, an impact at the geometric face center GFC of the club face is 0 on the graph, with negative numbers showing an impact toward the sole and positive numbers showing an impact toward the crown. The inventive club may result in an increase, for the average PGA Tour player, in his fairway wood distance of 7 yards (245 yard to 252 yards) for a center shot, and a 60% reduction in the error caused by a shot hit ⅛" too low on the face. Thus, the club with the slot 40 would hit a ⅛" thin shot 250.6 yards, versus 252.6 yards for a center shot for a difference of 2 yards, while a conventional club would hit a ⅛" thin shot 240.5 yards versus 245.3 yards for a center shot for a difference of 4.8 yards. Thus, a club head according to the invention as shown in FIG. 1 is more forgiving of shots hit low on the club face.

Figure 10:
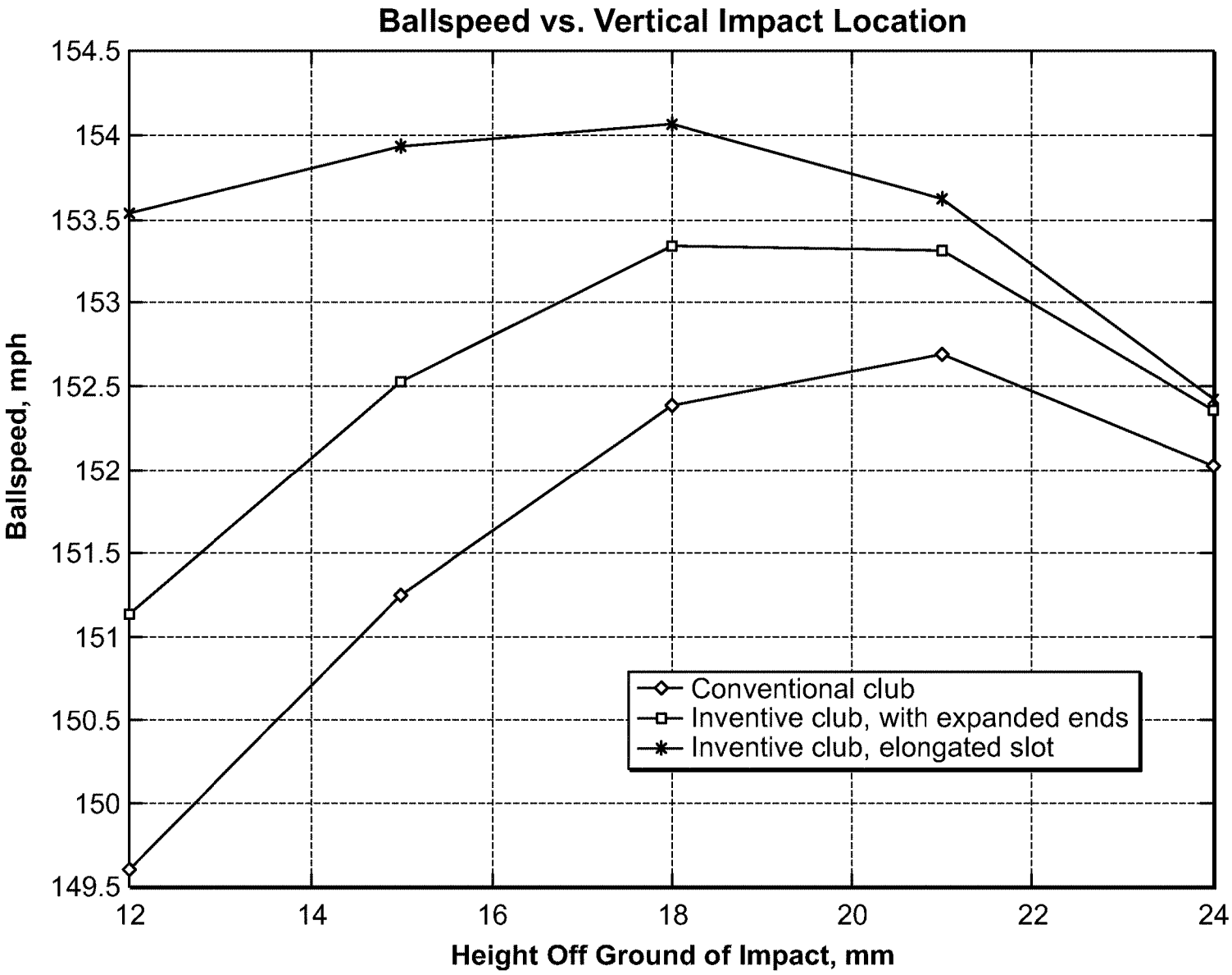
FIG. 10 is a graph of impact speed versus vertical impact position and the club head construction for the inventive club and a conventional club.

FIG. 10 illustrates a graph showing ballspeed versus height off the ground at impact for a conventional club without a slot, a club according to the invention as shown in FIG. 5 with a slot 40 having expanded slot portions 66 and 68 in the perimeter region 30 of the sole portion 22, and a club according to the invention as shown in FIG. 1 with an elongated slot in the perimeter region of the sole portion 22. Generally, with shots hit lower on the club face the slots 40 provide an increase in ballspeed. For example, at about 12 mm from the ground the club with the slot having expanded slot portions provides about an additional 1.5 mph of ballspeed compared with a conventional club, while the club with the elongated slot provides about an additional 4 mph of ball speed compared to a conventional club. The higher off the ground the impact, the less the increase in ballspeed when compared to a conventional club. Preferably, the speed at which a golf ball rebounds from the face insert of the inventive club head is increased at least 0.5 mph as compared with a club head without a slot. The speed at which a golf ball rebounds from the face insert of the inventive club head may be increased by at least 0.3 mph, preferably at least 0.5 mph and more preferably at least 1 mph as compared with a conventional club.

Figure 11:
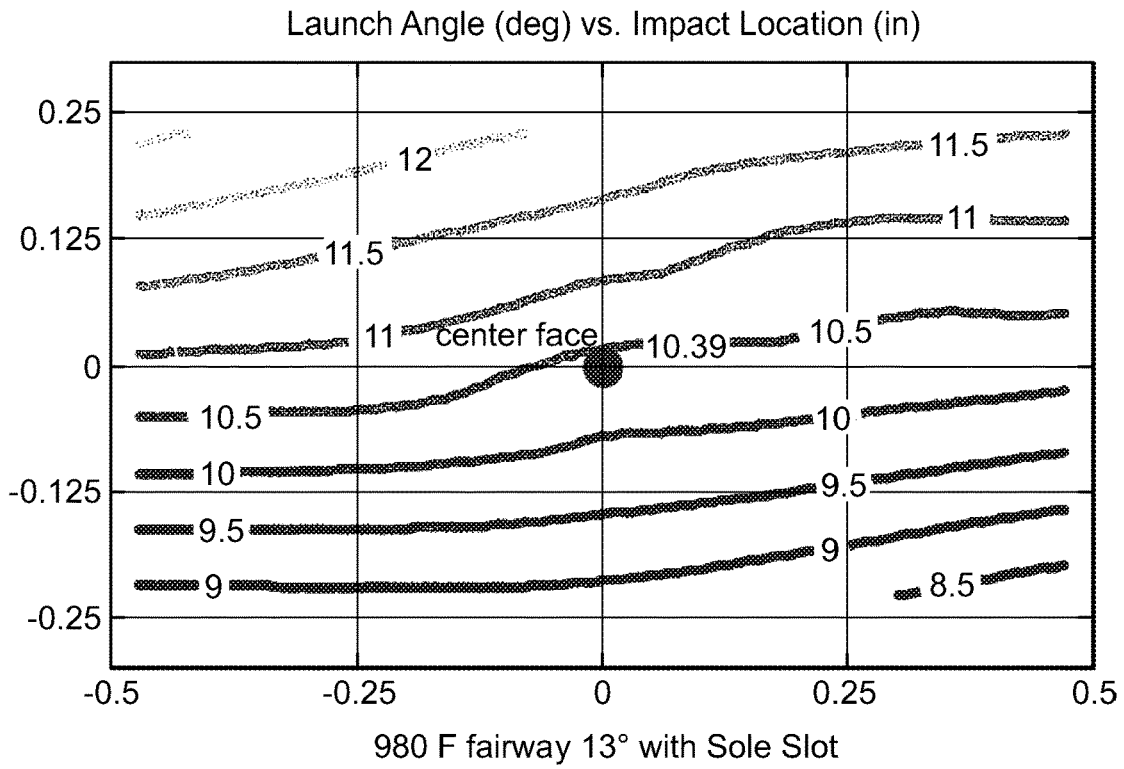
FIGS. 11-12 are graphs of launch angle versus vertical impact position and the club head construction for the inventive club and a conventional club.
Figure 12:
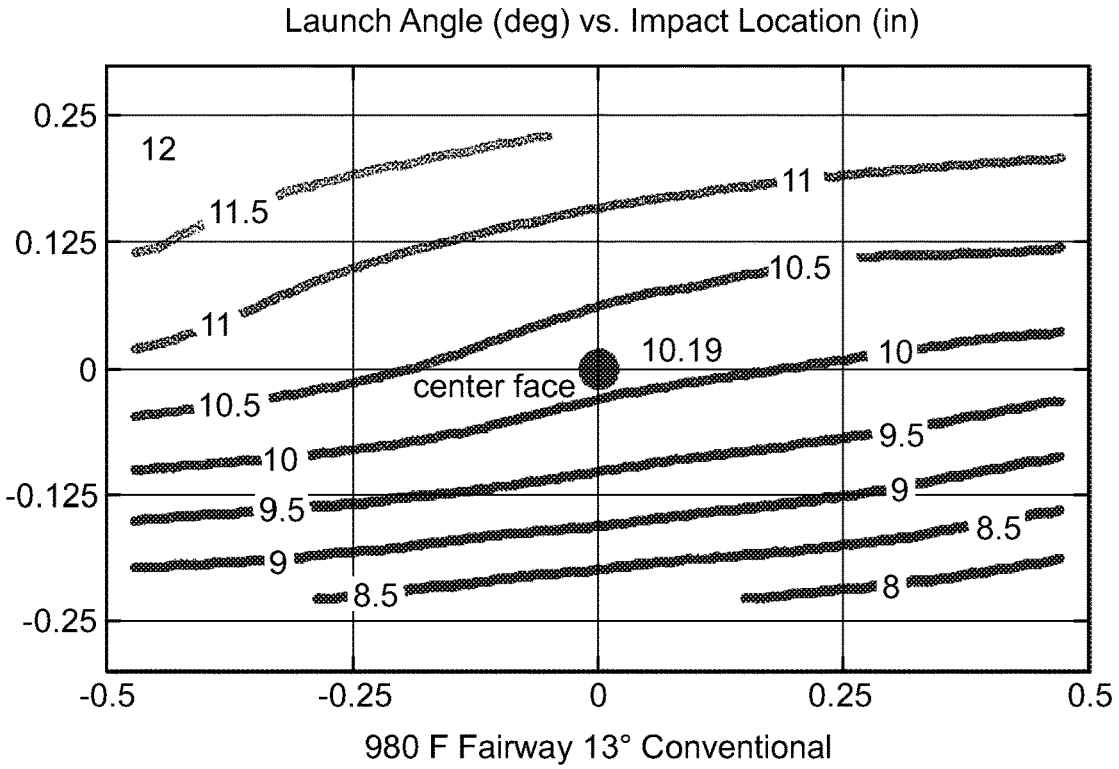

Referring to FIGS. 11-12, graphs plotting launch angle versus impact location for a fairway wood having a slot 40 according to the invention and for a conventional club without a slot are illustrated. The conventional club is a Titleist 980F Fairway wood with a 13° loft, and the inventive club is the same club having a slot 40 provided in the perimeter region 30 of the sole portion 22 as illustrated in FIG. 1. A comparison of the graphs illustrates that the club according to the invention has an increase in launch angle for similar impact positions. Preferably, the launch angle at which a golf ball leaves the face insert 16 of the inventive club is increased by at least 0.5 degrees as compared with a conventional club without a slot in the club head. The launch angle at which a golf ball leaves the face insert 16 of the inventive club may be increased by at least 0.3 degrees, preferably at least 0.5 degrees and more preferably at least 1 degree as compared with a conventional club.

Figure 13:
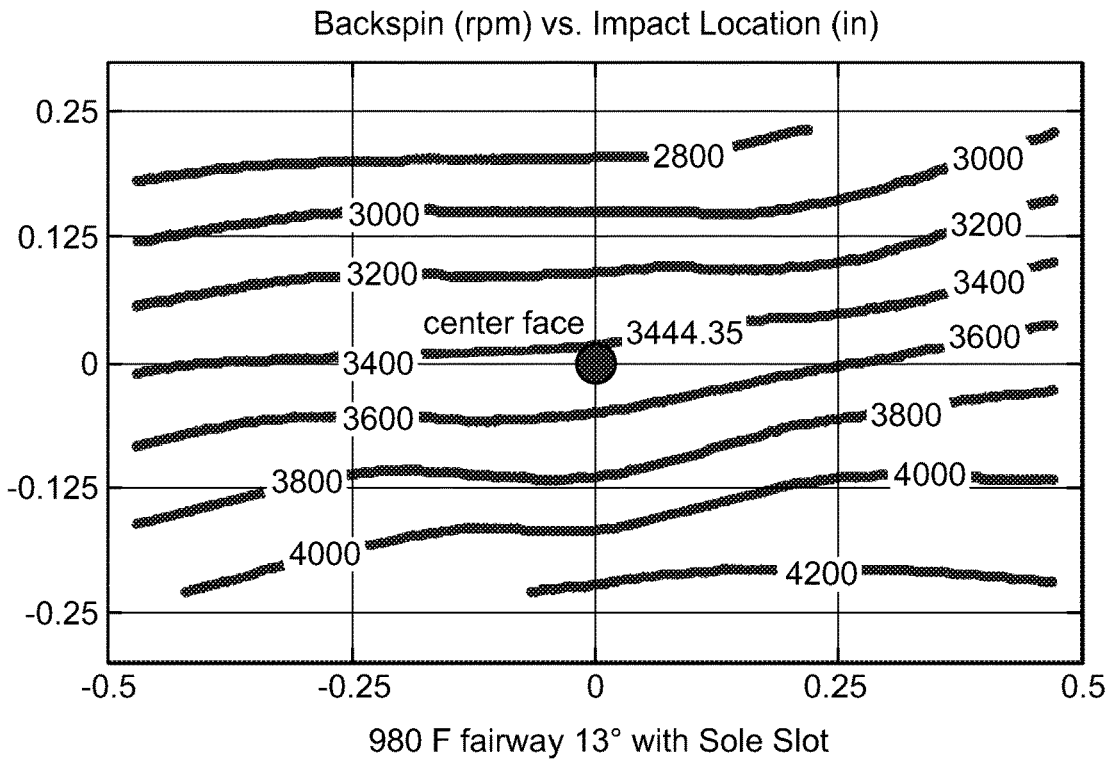
FIGS. 13-14 are graphs of back spin versus vertical impact position and the club head construction for the inventive club and a conventional club.
Figure 14:
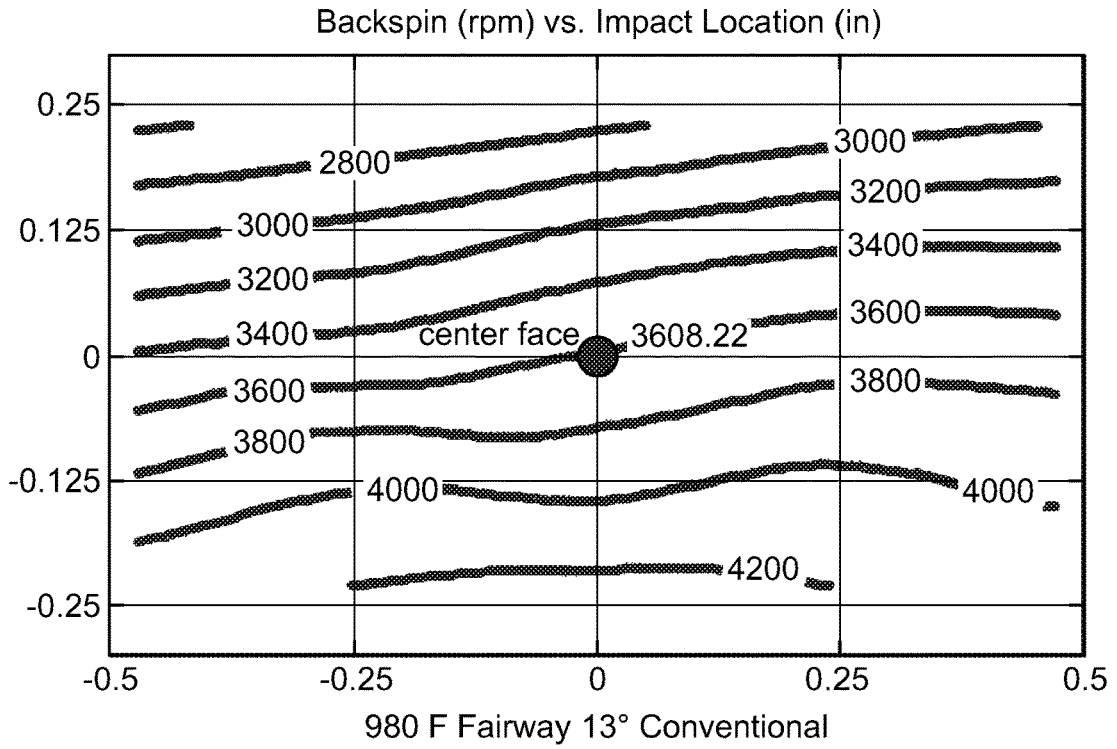

FIGS. 13-14, illustrate graphs plotting back spin versus impact location for a fairway wood having a slot 40 according to the invention and for a conventional club without a slot. The conventional club is a Titleist 980F Fairway wood with a 13° loft, and the club according to the invention is the same club having a slot 40 provided in the perimeter region 30 of the sole portion 22 as illustrated in FIG. 1. A comparison of the graphs illustrates that the inventive club has a decrease in back spin for similar impact locations. Preferably, the back spin of a golf ball leaving the face insert 16 of the inventive club is decreased by at least 100 rpm as compared with a conventional club without a slot in the club head. Thus, a golf club according to the invention is more forgiving of off-center hits than a conventional club without a slot. The back spin of a golf ball leaving the face insert of the inventive club may be decreased by at least 50 rpm, preferably 100 rpm, and more preferably 150 rpm as compared with a conventional club.

Figure 15:
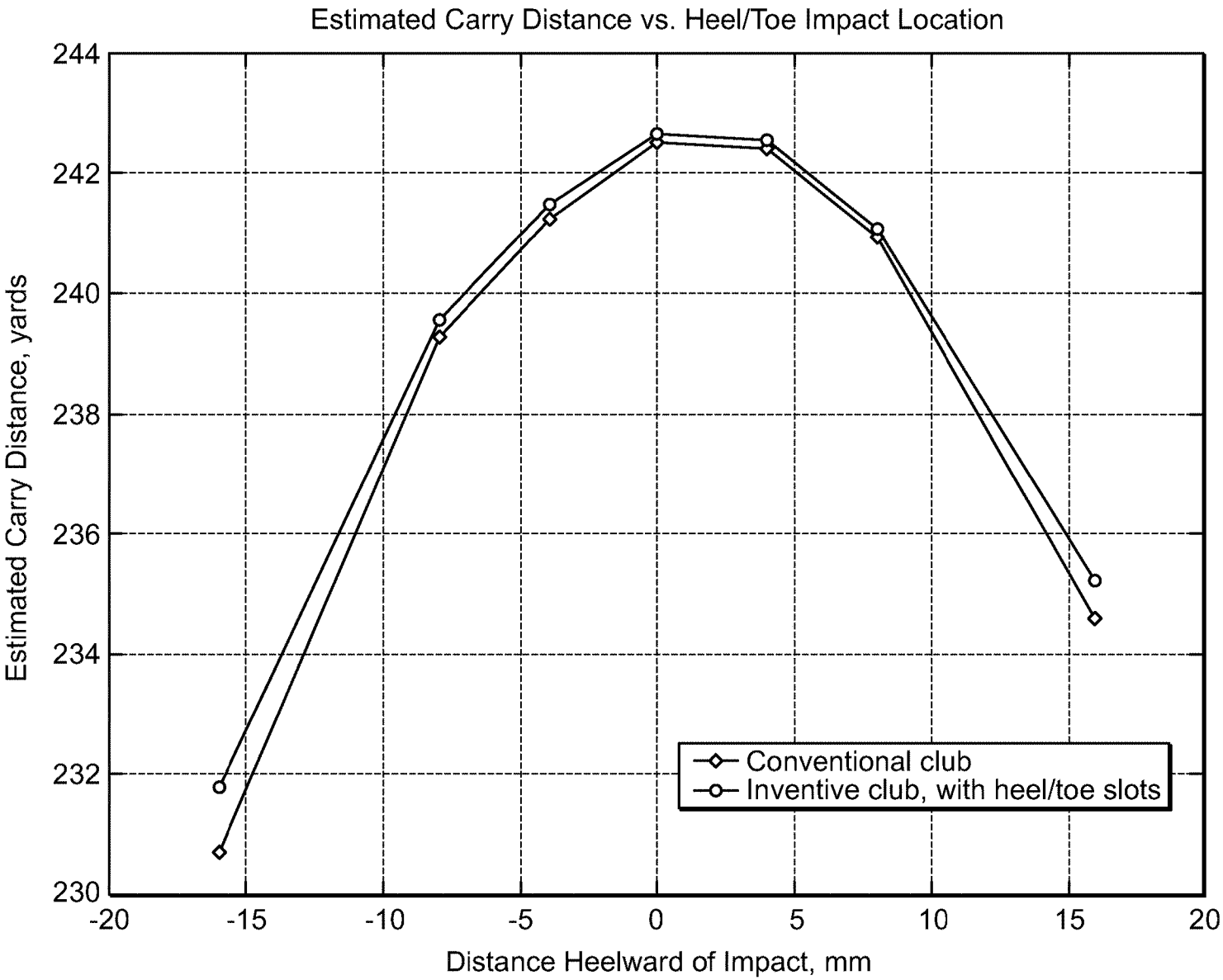
FIG. 15 is a graph of estimated carry distance versus heel/tow impact position and club head construction for the inventive club and a conventional club.

As illustrated in FIG. 15, a graph of estimated carry distance versus distance heelward of impact for a conventional club having no slot and a club according to the invention having a slot in the heel and toe as illustrated in FIG. 8 is shown. As illustrated the farther from the geometric face center GFC of the club face the ball is hit (the geometric face center GFC between the heel and toe being 0 in the graph) the more distance a club according to the invention provides. For example, at −16 mm from geometric face center GFC the inventive club provides over an additional yard of distance, while at +16 mm the inventive club provides almost an additional yard. Thus, a club with a slot 40 according to the invention as illustrated in FIG. 8 is more forgiving of hits not directly on the geometric face center GFC of the club head 10 between the heel and toe than a conventional club.

Tests results of the inventive and conventional golf clubs illustrated in FIGS. 9-15 were performed using finite element analysis (FEA) software, and these results were confirmed by robot testing.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, the face insert may have thickness variations in a step-wise or continuous fashion. In addition, the shapes and locations of the slots are not limited to those disclosed herein. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

I claim:

1. A golf club head, comprising:

a hollow body having a perimeter region and a face, the hollow body defining an inner cavity, the face having a geometric face center and an area of maximum coefficient of restitution, wherein the hollow body comprises a slot disposed in the perimeter region forming an opening into the inner cavity of the hollow body, an elastomeric insert disposed in the slot, and at least partially filling the slot, wherein an interior surface of the elastomeric insert is exposed to the inner cavity and an exterior surface of the elastomeric insert is exposed to an exterior of the golf club head, wherein the elastomeric insert has a protrusion extending outward from a side wall of the elastomeric insert, and wherein the protrusion extends into a groove in a wall of the slot so that the insert is kept within the slot, and wherein the groove is not exposed to the exterior of the golf club head, wherein the area of maximum coefficient of restitution is disposed within a zone on the face and the area of maximum coefficient of restitution is disposed less than 20 mm from the geometric face center, and wherein the maximum coefficient of restitution is at least about 0.82.

2. The golf club head of claim 1, wherein the protrusion is disposed on the side wall so that it is spaced from the interior surface and spaced from the exterior surface of the elastomeric insert.

3. The golf club head of claim 1, wherein the area of maximum coefficient of restitution is disposed less than 10 mm from the geometric face center.

4. The golf club head of claim 3, wherein the area of maximum coefficient of restitution is disposed within 2 mm of the geometric face center.

5. The golf club head of claim 1, wherein the slot has a width of greater than 1 mm.

6. The golf club head of claim 1, wherein the slot has a length of greater than 15 mm.

7. The golf club head of claim 1, wherein the slot provides a space in the body, such that the face flexes when the face impacts a golf ball.

8. The golf club head of claim 1, wherein the face defines a face plane and the slot is disposed less than 30 mm from the face plane.

9. A golf club head, comprising:

a hollow body having a perimeter region and a face, the hollow body defining an inner cavity, the face having a geometric face center and an area of maximum coefficient of restitution, wherein the hollow body comprises a slot forming an opening into the inner cavity of the hollow body, wherein the slot is formed between a portion of a sole of the hollow body and a portion of the perimeter region, and an elastomeric insert disposed in the slot, and at least partially filling the slot, wherein an interior surface of the elastomeric insert is exposed to the inner cavity and an exterior surface of the elastomeric insert is exposed to an exterior of the golf club head, wherein the elastomeric insert has a protrusion extending outward from a side wall of the elastomeric insert, and wherein the protrusion extends into a groove in a wall of the slot so that the insert is kept within the slot, and wherein the groove is not exposed to the exterior of the golf club head, wherein the area of maximum coefficient of restitution is disposed within a zone on the face and wherein the area of maximum coefficient of restitution is disposed less than 20 mm from the geometric face center, and wherein the maximum coefficient of restitution is at least about 0.82.

10. The golf club head of claim 9, wherein the protrusion is disposed on the side wall so that it is spaced from the interior surface and spaced from the exterior surface of the elastomeric insert.

11. The golf club head of claim 9, wherein the area of maximum coefficient of restitution is disposed less than 10 mm from the geometric face center.

12. The golf club head of claim 11, wherein the area of maximum coefficient of restitution is disposed within 2 mm of the geometric face center.

13. The golf club head of claim 9, wherein the slot is substantially filled with an elastomeric material that is exposed to the inner cavity of the hollow body.

14. The golf club head of claim 9, wherein the slot has a width of greater than 1 mm.

15. The golf club head of claim 9, wherein the slot has a length of greater than 15 mm.

16. The golf club head of claim 9, wherein the slot provides a space in the body, such that the face flexes when the face impacts a golf ball.

17. The golf club head of claim 9, wherein the face defines a face plane and the slot is disposed less than 30 mm from the face plane.

* * * * *